US005692888A

United States Patent [19]

Truninger

[11] Patent Number: 5,692,888

[45] Date of Patent: Dec. 2, 1997

[54] GEAR TRAIN MECHANISM HAVING REDUCED LEAKAGE

[75] Inventor: Paul Truninger, Langendorf/Solothurn, Switzerland

[73] Assignee: Truninger AG, Langendorf/Solothurn, Switzerland

[21] Appl. No.: 562,254

[22] Filed: Nov. 22, 1995

[30] Foreign Application Priority Data

Oct. 24, 1995 [DE] Germany ..... 295 16 780.7

[51] Int. Cl.[6] ..... F01C 1/10; F01C 1/18; F01C 19/00; F01C 21/10

[52] U.S. Cl. ..... 418/170; 418/179; 418/206.1; 418/206.5; 418/206.7; 418/206.9

[58] Field of Search ..... 418/170, 179, 418/206.1, 206.5, 206.7, 206.9

[56] References Cited

U.S. PATENT DOCUMENTS

| | | | |
|---|---|---|---|
| 1,837,446 | 12/1931 | Kauffman | 418/206.7 |
| 2,176,388 | 10/1939 | Bochmann | 418/179 |
| 3,204,564 | 9/1965 | Eltze | 418/170 |
| 3,263,425 | 8/1966 | Rohde | 418/206.1 |
| 3,274,894 | 9/1966 | Junger | 418/206.5 |
| 3,463,089 | 8/1969 | Newborough | 418/179 |
| 4,285,640 | 8/1981 | Mukai | 417/269 |
| 4,770,617 | 9/1988 | Hertell | 418/206.1 |
| 4,846,641 | 7/1989 | Pieters et al. | 418/206.7 |
| 5,318,425 | 6/1994 | Jetzer et al. | 418/91 |

FOREIGN PATENT DOCUMENTS

| | | | |
|---|---|---|---|
| 59-131787 | 7/1984 | Japan | 418/170 |
| 666517 | 7/1988 | Switzerland | 418/170 |

*Primary Examiner*—John J. Vrablik
*Attorney, Agent, or Firm*—Henry M. Feiereisen

[57] ABSTRACT

A gear train mechanism includes a housing having side walls that are made of a material exhibiting a modulus of elasticity of at least 140 GPa. A pair of shafts is supported by slide bearings in the housing and exhibit a length of at least of 1.3 times the diameter of the shafts. A first gear of external-tooth type is mounted on one shaft and is defined by an addendum diameter, a top land width and a circular pitch, with the top land width being at least 15% of the circular pitch. A second gear is mounted on the other shaft and is in mesh with the first gear, with both gears disposed between the side walls, wherein the side walls have a wall thickness of at least 75% of the addendum diameter.

10 Claims, 2 Drawing Sheets

GEAR TRAIN MECHANISM HAVING REDUCED LEAKAGE

BACKGROUND OF THE INVENTION

The present invention refers to a gear train mechanism for use in e.g. a gear pump or gearmotor, and in particular to a gear train mechanism of a type including at least one gear of the external-tooth type in mesh with at least one further gear between adjoining side walls of a housing, with the gears being mounted on shafts which are supported in the side walls by means of slide bearings.

Examples for use of gear trains include external or internal gear pumps or external or internal gearmotors. In general, external gear trains exhibit two or more gears of the external-tooth type which mesh to provide a certain action. Internal gear trains include at least one gear of the external-tooth type that is in mesh with at least one gear of the internal-tooth type. The constructional principle of rotary positive displacement units is also applicable for torque motors. In particular gear pumps and gearmotors are configured based on the same principle.

It is noted at this point that unless a reference is expressly made to gear pumps or gearmotors, the use of the term "gear train mechanism" shall encompass gear pumps and gearmotors as the structural principles, as stated above, are basically the same.

For energy-saving reasons, the efficiency of the machine is generally of great importance. In particular, the volumetric efficiency can be influenced by constructional measures. In gear train mechanisms, internal and external fluid leakages are encountered at zones that exhibit a gap formed between components which move relative to one another, e.g. between stationary parts and rotating parts. Fluid leakage is particularly experienced between pressure compartment and suction compartment. Essentially three different zones of fluid leakages can be differentiated:

1. at the end face of each gear,
2. along the gear addendum circle,
3. at the slide bearing of a shaft.

Leakage loss increases proportionally with the pressure and is raised to the third power of the gap width, i.e. the distance between components that move relative to each other, and is inversely proportional to the gap length, i.e. the distance being overcome by the fluid leakage.

Without suitable measures, gear train mechanisms are not suitable for higher static pressures in the range above 100 bar because for reasons of operational safety and precision, the gap cannot be narrowed randomly. Moreover, leakage loss increases in particular along the gear end faces due to housing deformations that are caused by rising pressure.

Leakage loss is conventionally reduced through gap compensation, by keeping constant or narrowing the gap between components that move relative to each other, e.g. between the end faces of the gears and adjoining housing areas, and lead to fluid leakage between the pressure compartment and the suction compartment, through pressure-loaded parts in dependence on the applied pressure. At least a housing deformation is compensated in this manner.

Gear pumps or gearmotors configured in this manner have the drawback that the formed very small gap requires operation with a finely filtered fluid. In practice, such preconditions are rarely met. Thus, when using standard fluids that contain some impurities, a premature wear of the sealing components is a consequence so that the service life of such gear pumps or gearmotors is limited and the originally good efficiency gradually decreases during course of operation and depending on the degree of contamination.

Moreover, such gear pumps or gearmotors that include gap compensation means are complex and cost-intensive. Also, the contact pressure applied on the parts for the gap compensation results in frictional forces which adversely affect the mechanical efficiency and thus the overall efficiency.

Gap-compensated gear train mechanisms for higher pressures exhibit essentially small but short gaps (short gap length) for sealing purposes. In non-compensated gear train mechanisms, the omission of compensation components results in greater and significantly longer sealing surfaces (longer gap length) for a lateral sealing of the gear end faces. Especially at higher pressures in the range above 100 bar, the increasing gap width encountered with rising pressure due to the bending side walls of the housing becomes increasingly disadvantageous.

Leakage losses are also significant along the gear addendum circle of gear pumps or gearmotors. The tooth geometry has to meet a number of requirements to attain optimum results, e.g. a great displacement volume at given structural volume, involute tooth profile for simplified manufacture, length of contact with positive contact ratio, a reduced number of teeth for noise reasons, etc. Therefore, gears are conventionally formed with relatively pointed teeth, with a top land width in the range of only about 5% of the circular pitch. Thus a very short gap length is generated between the rotating gear tip and the stationary housing part, leading to significant leakage loss along the gear addendum.

Moreover, conventional gear pumps or gearmotors exhibit external fluid leakage at the slide bearings for the shafts.

SUMMARY OF THE INVENTION

It is an object of the present invention to provide an improved gear train mechanism for use in gear pumps, gearmotors or the like, obviating the afore-stated drawbacks.

In particular, it is an object of the present invention to provide an improved gear train mechanism by which a volumetric efficiency and overall efficiency is attained that is comparable to those achieved by gap-compensated mechanisms, without requiring such a gap compensation.

These objects and others which will become apparent hereinafter are attained in accordance with the present invention by providing side walls with a wall thickness of at least 75% of the addendum diameter and made with a material exhibiting a modulus of elasticity of at least 140 GPa, and by configuring the top land width of the gears at least 15% of the gear pitch, and by configuring the slide bearing of a length at least 1.3 times the diameter of the supported shaft.

Through configuration of the gear train mechanism in accordance with the present invention, the deflection of the side walls is reduced to a degree which is small in comparison to the gap width. Preferably, the wall thickness is in the order of approximately 80% of the addendum diameter, and the material for the side walls has a modulus of elasticity of 150–230 GPa. The configuration of the side walls according to the present invention limits fluid leakage through the gap between the side walls and the gear end faces. A suitable material for the side walls is e.g. steel or spherulitic graphite iron. The use of aluminum is generally unsuitable because of the small modulus of elasticity of about 70 GPa.

According to another feature of the present invention, the gears exhibit a tooth flank profile with a top land width as broad as possible. Preferably, the top land width of the teeth amounts to 20% of the pitch. Compared to conventional top land widths of only 5–8% of the pitch, the gear train mechanism according to the present invention exhibits a substantially longer gap length and thus a significantly improved sealing action.

Moreover, in accordance with the present invention, the fluid leakage at the slide bearings of the shafts can be reduced by incorporating extra long bearing bushes of a length preferably in the order of 1.4 times to 1.8 times the shaft diameter. This results in significantly longer gap length compared to conventional configurations that utilize bearing bushes at a length of approximately 0.8 times the shaft diameter. Since the slide bearings are formed in the side walls, a lengthening of the shafts permits the slide bearings to be simply extended. No complicated constructional measures are necessary.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
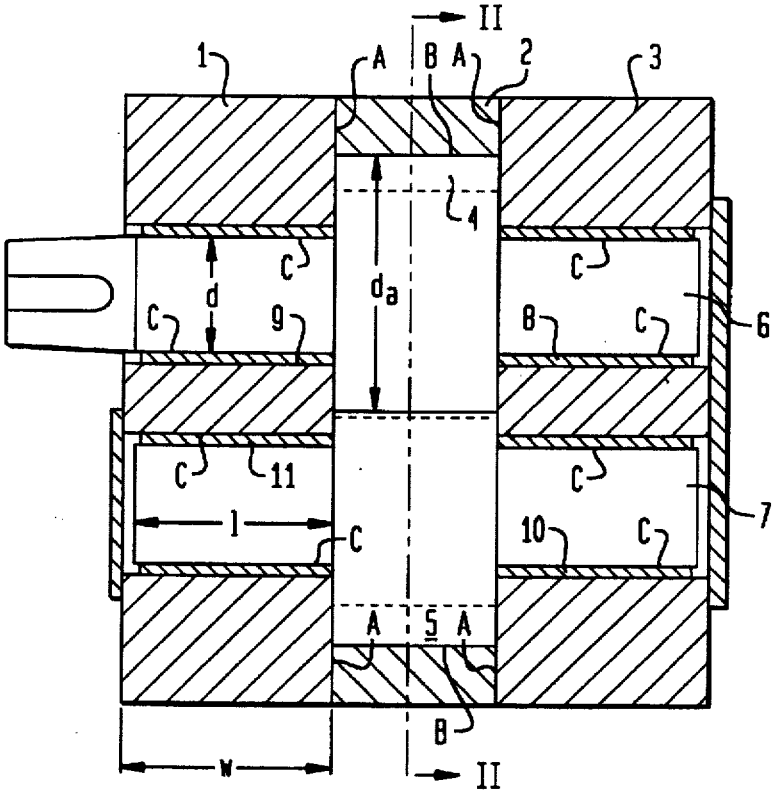
FIG. 1 is a cross sectional view of one embodiment of a gear train mechanism in form of an external gear pump according to the present invention, illustrating in detail the relationship between wall strength of the side walls and the addendum diameter as well as the relationship between slide bearing length and shaft diameter.

Turning now to the drawing, and in particular to FIG. 1, there is shown a cross-sectional view of one embodiment of a gear train mechanism in form of an external gear pump, according to the present invention, including a housing 2 having side walls 1, 3 in form of plates. The housing 2 supports two parallel shafts 6, 7 on which meshing gears 4, 5 of the external-tooth type are respectively mounted. In the non-limiting example of FIG. 1, the shaft 6 is driven while the shaft 7 is idle and driven via the meshing gears 4, 5. Each shaft 6, 7 is supported in the side walls 1, 3 by two slide bearings 8, 9; 10, 11.

Fluid leakage can be experienced wherever a gap is formed between components that move relative to each other. Essentially, three zones, denoted A, B, C, should be considered.

Leakage zone A is formed in the contact area between the gear end faces and the side walls 1, 3. In accordance with the present invention, the side walls 1, 3 have a wall thickness w which is about 80% of the addendum diameter $d_a$ so as to exhibit the required stiffness for withstanding high static pressures of above 100 bar and thus for preventing an excessive deflection. The positive effect of the wall strength can further be compounded by suitably selecting the material for the side walls 1, 3. Preferably, the side wall 1,3 are made of a material exhibiting a modulus of electricity of at least 140 GPa Examples for a suitable material for the side walls 1, 3 includes steel or spherulitic graphite iron. These constructional features limit a deflection of the side walls 1, 3 to such a degree that is small compared to the gap width.

The measures in accordance with the present invention to limit fluid leakage at zone B along the gear addendum will be described in more detail furtherbelow, with reference to FIG. 2.

The leakage zone C is formed along the slide bearings 8, 9; 10, 11 of the shafts 6, 7. The leakage loss is inversely proportional to the length I of the slide bearings 8, 9; 10, 11. The ratio of the length I relative to the shaft diameter d is approximately 1.4 to 1.8, preferably 1.5. This value significantly exceeds the conventional ratio which normally amounts to 0.8. Thus, leakage losses are considerably reduced. As the side walls 1, 3 are broader compared to conventional configurations, a lengthening of the shafts 6, 7 effects a greater length I of the slide bearings 8, 9; 10, 11, thereby increasing the gap length that is relevant for leakage losses. No complicated constructions are required.

Figure 2:
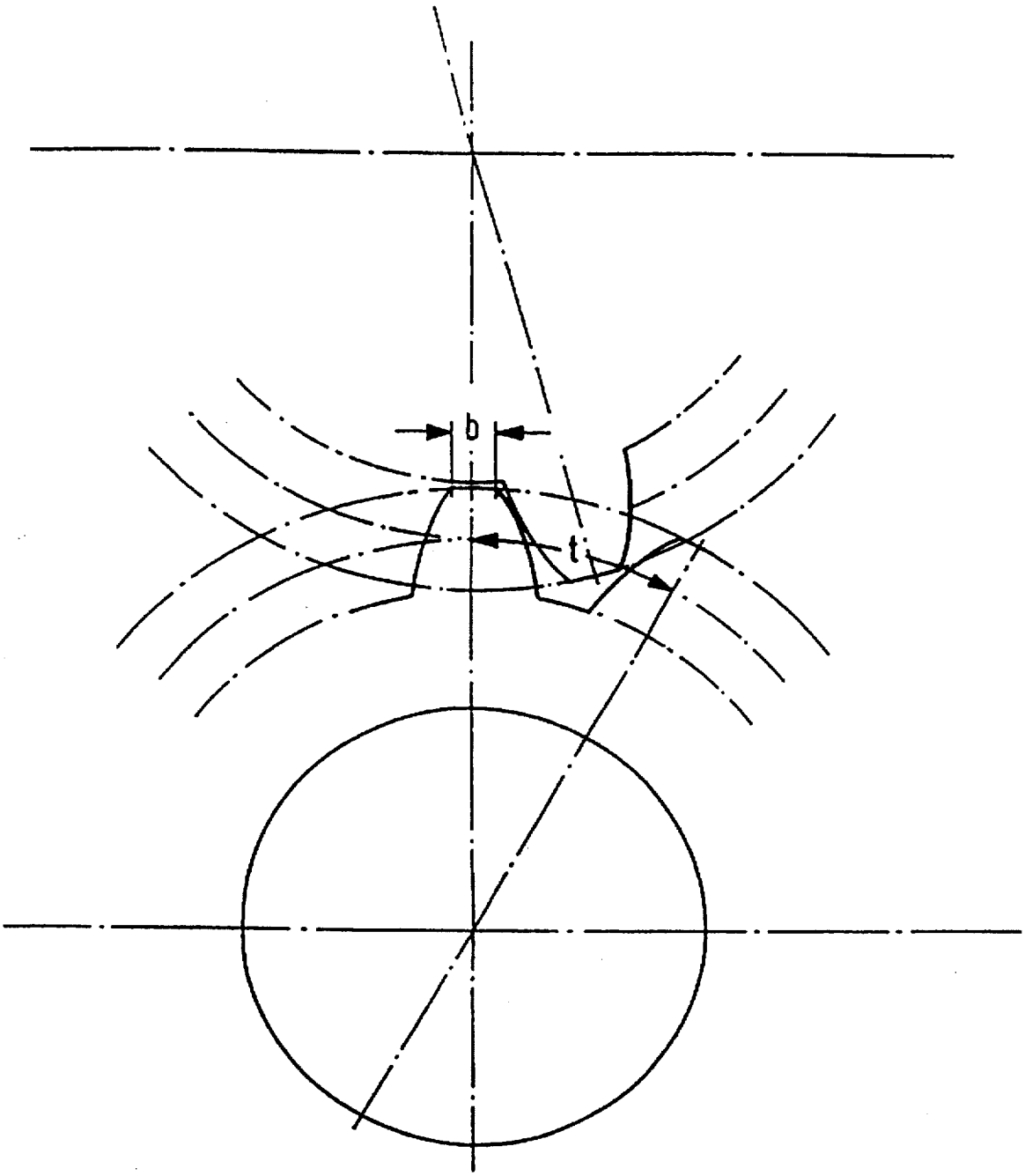
FIG. 2 is a fragmentary sectional view, taken along the line 11—11 in FIG. 1, illustrating the relationship between top land width and gear pitch.

Turning now to FIG. 2, there is shown a fragmented, sectional view of meshing teeth of gears 4, 5. Reference character b denotes the top land width, and reference character t denotes the circular pitch. In accordance with the present invention, the tooth flank profile is defined by a top land width b which is about 20% of the circular pitch t. Conventionally, the top land width is about 5 to 8% of the circular pitch. The top land width b corresponds to the gap length that is responsible for leakage loss at zone B. As again the leakage loss is inversely proportional to the gap length, the substantially longer top land width b results in significantly reduced leakage loss along the gear addendum.

Figure 3:
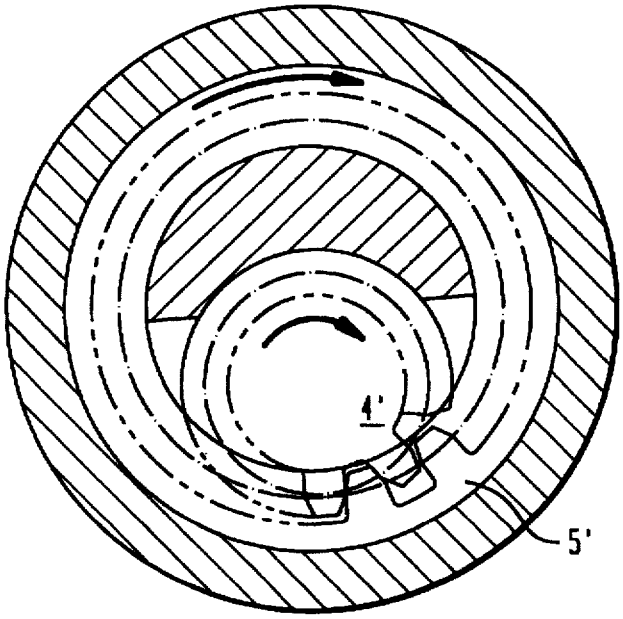
FIG. 3 is a cross sectional view of another embodiment of a gear train mechanism in form of an internal gear pump according to the present invention.

FIG. 3 shows a cross sectional view of another embodiment of a gear train mechanism in form of an internal gear pump according to the present invention, with at least one of the gears 4', 5' (here gear 5') being of the internal-gear type.

While the invention has been illustrated and described as embodied in a gear train mechanism, it is not intended to be limited to the details shown since various modifications and structural changes may be made without departing in any way from the spirit of the present invention.

What is claimed as new and desired to be protected by Letters Patent is set forth in the appended claims:

I claim:

1. A gear train mechanism; comprising:

a housing having side walls made of a material exhibiting a modulus of elasticity of at least 140 GPa;

at least two shafts, each shaft being defined by a diameter;

bearing means, including slide bearings for supporting said shafts in said housing, each said slide bearing exhibiting a length of at least 1.3 times the diameter of said shafts;

a first gear of external-tooth type mounted on one of said shafts, said first gear being defined by an addendum diameter, a top land width and a circular pitch, with the top land width being at least 15% of the circular pitch; and a second gear mounted on the other one of said shafts and in mesh with said first gear, said first and second gears being positioned between and adjacent said side walls, said side walls having a wall thickness that is at least 75% of the addendum diameter.

2. The gear train mechanism of claim 1 wherein the wall thickness of said side walls is in the range of 80% of the addendum diameter.

3. The gear train mechanism of claim 1 wherein said side walls are made of a material exhibiting a modulus of elasticity in the range of 150–230 GPa.

4. The gear train mechanism of claim 1 wherein said side walls are made of steel.

5. The gear train mechanism of claim 1 wherein said side walls are made of spherulitic graphite iron.

6. The gear train mechanism of claim 1 wherein the top land width is in the range of 20% of the circular pitch.

7. The gear train mechanism of claim 1 wherein said slide bearings have a length in the range of 1.4 to 1.8 times the diameter of said shafts.

8. The gear train mechanism of claim 1, including at least two gears of external-tooth type.

9. The gear train mechanism of claim 1, including at least one gear of internal-tooth type.

10. The gear train mechanism of claim 1 wherein one of said shafts is driven and the other one of said shafts is idle.

* * * * *

UNITED STATES PATENT AND TRADEMARK OFFICE

CERTIFICATE OF CORRECTION

PATENT NO. : 5,692,888
DATED : December 2, 1997
INVENTOR(S) : Paul Truninger

It is certified that error appears in the above-identified patent and that said Letters Patent is hereby corrected as shown below:

column 4, line 10 change "electricity" to --elasticity--

Signed and Sealed this

Fourteenth Day of July, 1998

Bruce Lehman

*Attest:*

BRUCE LEHMAN

*Attesting Officer*

*Commissioner of Patents and Trademarks*